United States Patent [19]

Reifel et al.

[11] Patent Number: 4,710,610

[45] Date of Patent: Dec. 1, 1987

[54] ELECTRIC RESISTANCE HEATER AND LIMIT SWITCH ASSEMBLY

[75] Inventors: Allan J. Reifel, Florissant; James E. Roth, DeSoto, both of Mo.

[73] Assignee: Nordyne, Inc., St. Louis, Mo.

[21] Appl. No.: 904,414

[22] Filed: Sep. 8, 1986

[51] Int. Cl.[4] ..... H05B 1/02; F24H 3/00; H01H 37/00

[52] U.S. Cl. ..... 219/363; 219/364; 219/374; 219/375; 219/532; 337/348

[58] Field of Search ..... 219/364–370, 219/374–376, 389–382, 532, 530; 337/348, 380

[56] References Cited

U.S. PATENT DOCUMENTS

| | | | |
|---|---|---|---|
| 2,080,799 | 5/1937 | Wiegand | 219/370 X |
| 2,488,636 | 11/1949 | Mendenhall et al. | 219/370 X |
| 3,102,185 | 8/1963 | Boyd et al. | 219/382 X |
| 3,440,400 | 4/1969 | Cotts | 219/376 X |
| 3,631,525 | 12/1971 | Brasch | 219/374 X |
| 3,731,056 | 5/1973 | Becker | 219/366 X |
| 3,750,076 | 7/1973 | Hines | 337/348 |
| 3,770,939 | 11/1973 | Kokjohn | 219/532 |
| 3,882,438 | 5/1975 | Bourner | 219/532 X |
| 3,912,903 | 10/1975 | Northrup et al. | 219/532 X |
| 4,131,789 | 12/1978 | Tyler | 219/532 X |

*Primary Examiner*—Anthony Bartis
*Attorney, Agent, or Firm*—Jerome A. Gross

[57] ABSTRACT

A heater and limit switch assembly, particularly useful for installation in the conditioned air duct of a rooftop air conditioner. The loop of a rigid-loop heater, mounted on a vertical plate by two parallel legs, is modified to provide an inward offset portion leading to the second leg. Radiation, from the offset portion and its bend into the second leg, is received at close range by a simple disk-type limit switch, positioned on the plate outward of the second leg and facing the offset, inducing prompt response to any increase over design temperature.

5 Claims, 3 Drawing Figures

ELECTRIC RESISTANCE HEATER AND LIMIT SWITCH ASSEMBLY

FIELD OF THE INVENTION

This invention relates to resistance heater and thermal limit switch assemblies designed for especially prompt response on temperature rise.

DESCRIPTION OF THE PRIOR ART

Sheathed electric resistance heaters, designed for installation in air ducts, may consist of rigid U-shaped finned resistance loops, mounted onto mounting plates by terminal ends parallel to each other. Such heaters must be cooled by air flowing downward through the ducts, to which air the finned loops transfer their heat. If this airflow is cut off or substantially diminished, the heaters may dangerously overheat.

To prevent such occurrence, heater assemblies are conventionally provided with heat-sensitive limit switches on the mounting plates. For optimum safety, even a small temperature rise above the design operating temperature of the heater should actuate the limit switch promptly, cutting off power to the heater.

It would be conventional to position a limit switch on the mounting plate between the terminal ends of the "U", to respond to radiation from the heater loop as a whole. However, radiant heat decreases so markedly with distance that such an installation may require the use of a highly sensitive expensive limit switch; otherwise there will result an excessive temperature rise before the switch responds.

Other limit switch installations, likewise expensive, have capillary tubes extending from the switches to surface portions of the loops; these respond directly to the surface temperatures of the loops.

SUMMARY OF THE INVENTION

The design and favorable positioning of elements of the present heater and limit switch assembly permits use of an inexpensive disk-type limit switch, insures rapid response to interruptions in the flow of air, and affords optimum protection against damage to air conditioning components.

The present invention utilizes a heater of modified-loop configuration, which is mounted on a vertical mounting plate from which extend two parallel leg portions of the loop. However, one side of the present loop has an inward offset leading to the second leg, which brings that leg closer to the first leg. The limit switch, of the inexpensive snap-disk type, is located on the mounting plate outward of the second leg and facing this inward offset portion. This limit switch receives radiation, at close range, both from the offset portion and the poriton defining the bend into the second leg. This close-range radiation affords substantially quicker cut-off response time, even using the inexpensive disk-type limit switch.

DESCRIPTION OF THE PREFERRED EMBODIMENT

Figure 1:
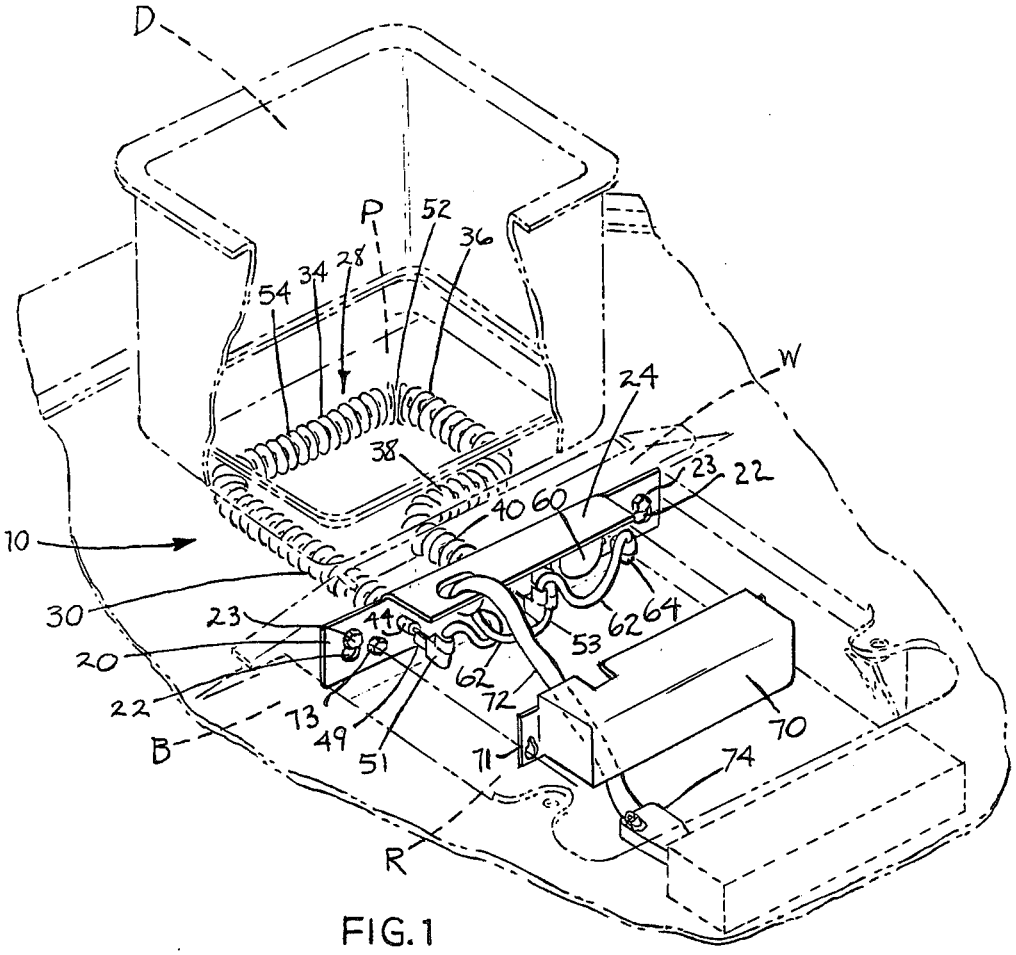
FIG. 1 is a fragmentary perspective view from above showing the installation of the present heater and limit switch assembly below the duct outlet from a rooftop air conditioner at the entrance to a ceiling air distributor box.

The electrical resistance heater and limit switch assembly generally designated 10 of the present invention is here illustrated mounted within a duct D leading downwardly from a rooftop air conditioner, through a plenum P, to an air distributor box B, as shown in phantom lines in FIG. 1. The assembly 10 includes a mounting plate 20, a finned electrical resistance heater generally designated 28 and a limit switch 60, all hereafter described.

Figure 2:
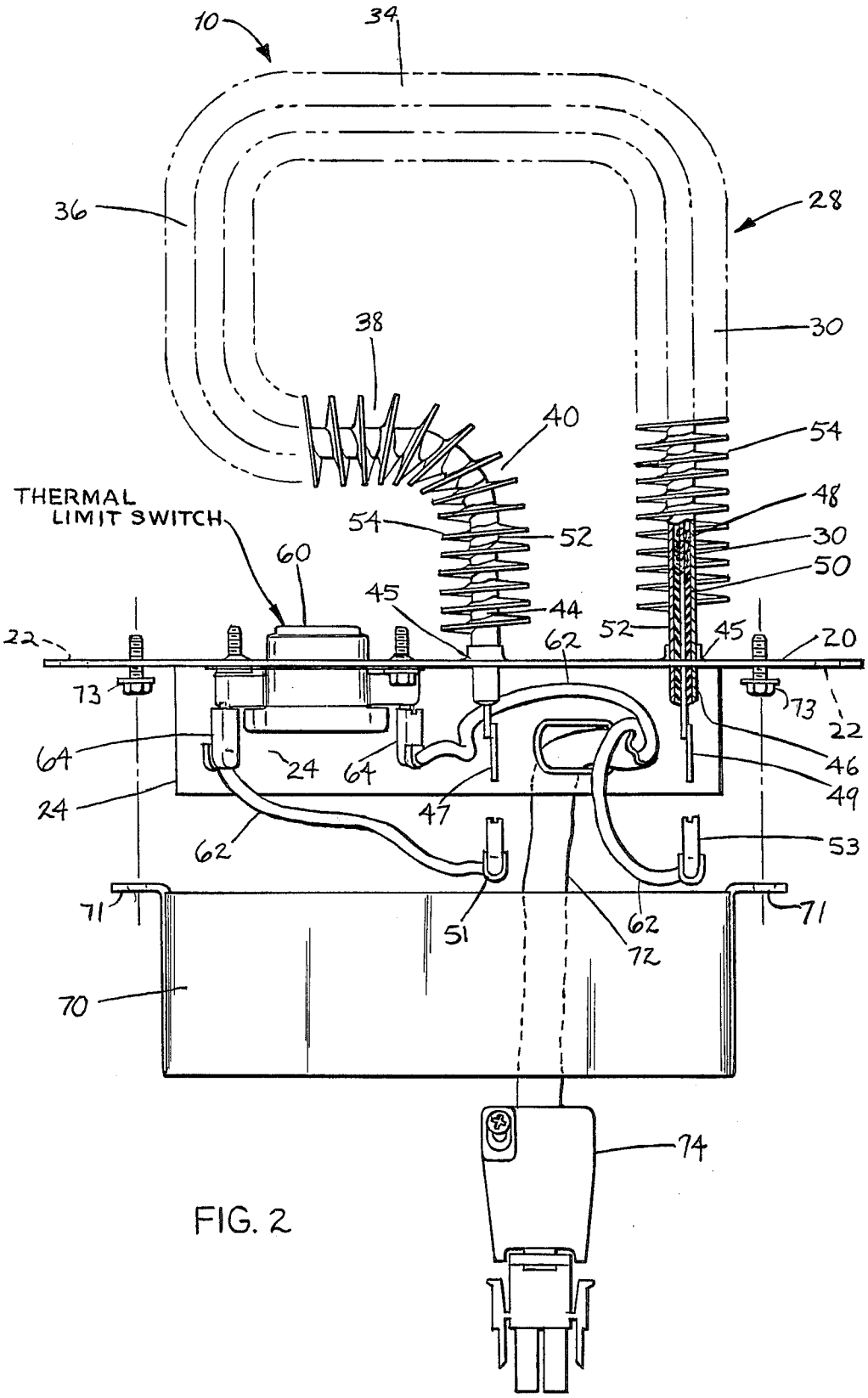
FIG. 2 is a plan view from below with the junction box cover exploded.

Mounted onto the vertical sheet metal mounting plate 20 to project horizontally into such plenum P is a rigid planar loop electrical resistance heater 28, of conventional construction, best shown in FIG. 2. The heater 28 has two parallel cold terminal ends 44, 46, mounted in collars 45 extruded from the mounting plate 20, to extend perpendicular to it. Portions of the cold terminal ends 44 continue a short distance inward of the mounting plate 20 where they connect with the heater resistance wire 48. The resistance wire 48 and portions of the cold terminal ends 44, 46 are shielded by electrical insulation 50 and sheathed by an outer ductile metal tubing 52. Outward of the mounting plate 20, end portions of the cold terminal ends 44, 46 are attached to blade terminals 47, 49; these are engaged by blade-type sockets 51, 53, shown disconnected in FIG. 2. On the inward side of the plate 20, a continuous spiral fin 54 of steel or aluminum substantially surrounds the tubing 52.

The otherwise conventional heater 28 is bent to the modified loop configuraiton seen in FIG. 2. A first end leg 30 of the loop, starting with the plate 20, extends to a 90° bend leading into a second loop portion 34. This second loop portion 34 extends sideward to another 90° bend, leading into an initial return portion 36 which is substantially parallel to but shorter than the first end leg 30. Continuing from a 90° bend at the end of this initial return portion 36 is an inward offset portion 38, directed toward the first end leg 30; in the embodiment illustrated, this portion is substantially parallel to the mounting plate 20 and its length is substantially less than—here about half as long as—the second portion 34. Completing the loop, the heater 28 is then bent to a substantially 90° arc to a short second end leg 40, whose cold terminal end 46 is similarly mounted to the mounting plate 20.

Figure 3:
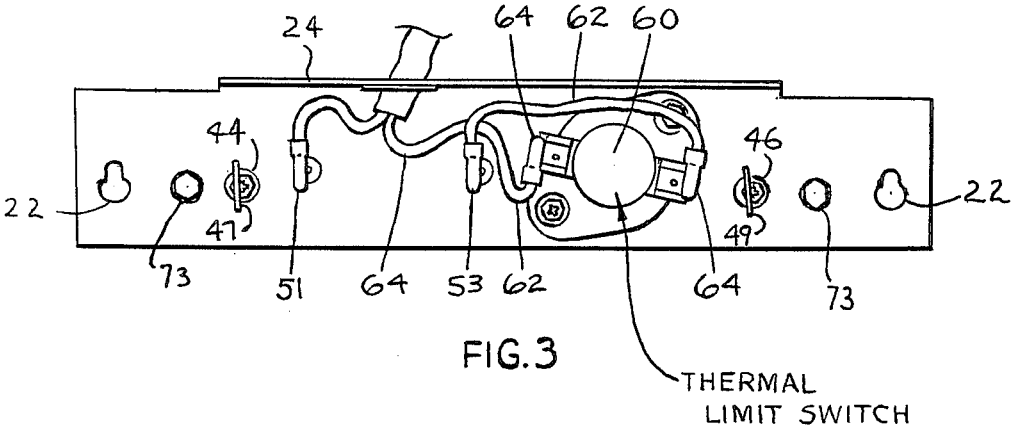
FIG. 3 is an elevation view of the terminal side of the mounting plate seen in FIG. 1.

A snap-disk type limit switch 60 is mounted onto the mounting plate 20 outwardly of the second end leg 40 and facing the inward offset portion 38 of the heater loop. This position is substantially at a point about which is described the arc of the bend of the inward offset 38 into the second end leg 40. The terminals 64 of the limit switch 60, best seen in FIG. 3, are connected by wiring 62 in series with the heater 28.

The assembly 10 is completed by fitting a sheet metal juntion box cover 70 having key-slotted end flanges 71, over screws 73 projecting from the mounting plate 20, to rest on its upper flange portion 24. This provides a heater junction box, which encloses the terminals and wiring so connected. A power cable 72 leads outwardly from the junction box cover 70 to a terminal plug 74, which is conventionally connected through switch controls, not shown, to a power source.

A typical use of the present heater is to supplement a rooftop air conditioner which discharges air downward through a duct D to a plenum P and air distributor box B, shown in phantom lines in FIG. 1. The heater 28 is mounted in the plenum P by inserting its loop through a horizontal aperture in a vertical wall W common to the plenum P and the return air inlet R; this inlet is readily accessible from beneath. Key-hole slots 22 on the mounting plate 20, spaced farther apart than the width of the aperture, engage onto spaced apart screws 23 projecting from the common wall; the heater 28 thus projects horizontally into the plenum P above and parallel to the bottom of the air distributor box B.

During operation of the assembly 10, air flows downward through the duct to be heated by the heater 28. If the airflow should be cut off or substantially impaired, the temperature of the heater 28 will rise. The limit switch 60, receiving optimal exposure to radiant heat from both the inward offset 38 and the bend portion into the second end leg 40 of the heater loop, responds to a relatively small temperature rise, breaking the series circuit to the heater. The present arrangement thus provides maximum protection against overheating, such as damage to the air distributor box B.

A limiting design consideration is the radius of curvature to which the tubular sheathed heater 28 may be bent without damaging it. For fastest response of the limit switch 60, the inward offset 38 and second end leg 40 should be as close to the switch 60 as is feasible without subjecting the heater element 28 to extreme bending.

As various modifications may be made in the construction herein described and illustrated without departing from the scope of the invention, it is intended that all matter contained in the foregoing description or shown in the accompanying drawings shall be interpreted as illustrative rather than limiting.

We claim:

1. A heater and limit switch assembly adapted for installation within an air duct, comprising a mounting plate, a rigid planar modified-loop electrical resistance heater comprising a first elongated end leg portion mounted at one end onto and substantially perpendicular to said mounting plate and terminating at its other end at the first end of an elongated second portion, said second portion extending substantially perpendicular to said first end leg portion, an elongated initial return portion extending from the other end of said second portion, substantially parallel to and spaced from said first end leg portion, and, continuing therefrom, an inward offset portion extending toward said first end leg portion and substantially parallel to and spaced from said mounting plate, the length of said offset portion being substantially less than said second portion, and terminating in a second end leg portion spaced from and substantially parallel to said first end leg portion and mounted onto and substantially perpendicular to said mounting plate, in combination with a temperature responsive limit switch mounted on said plate outwardly of said second end leg portion and inwardly of said initial return portion and facing said inward offset portion, whereby said modified loop configuration, and particularly the inward offset and second leg portions thereof, together with the mounted position of said limit switch relative thereto, afford improved response to temperature rise of the loop.

2. A heater and limit switch assembly as defined in claim 1, wherein the juncture of said second end leg portion and said inward offset portion is characterized by an arcuate bend, the position at which the limit switch is so mounted on the mounting plate being substantially at a point about which the arc of such bend is described, whereby to provide optimum exposure of said limit switch to radiant heat from the heater portions in and adjacent to such bend.

3. A heater and limit switch assembly adapted for installation within a vertical air duct, comprising a mounting plate, a rigid planar modified-loop electrical resistance heater of the type having an insulated resistance wire sheathed in ductile tubing cooled by a continuous spiral fin, said heater comprising a first elongated end leg portion including an unfinned tubing end mounted onto and substantially perpendicular to said mounting plate and terminating at its other end at the first end of an elongated second portion, said second portion extending substantially perpendicular to said first end leg portion, an elongated initial return portion extending from the other end of said second portion, substantially parallel to and spaced from said first end leg portion, and, continuing therefrom, an inward offset portion extending toward said first end leg portion and substantially parallel to and spaced from said mounting plate, the length of said offset portion being substantially less than said second portion, and terminating in a second end leg portion spaced from and substantially parallel to said first end leg portion and including an unfinned tubing end mounted onto and substantially perpendicular to said mounting plate, the juncture of said second end leg portion and said inward offset portion being characterized by an arcuate bend, said resistance wire having cold terminal ends within said tubing ends, which terminal ends extend beyond said mounting plate into said first and second end leg portions, in combination with a thermal limit switch of the snap-disk type connected in series with said heater and mounted on said plate outwardly of said second end leg portion and inwardly of said initial return portion and facing said inward offset portion, the position of its mounting being substantially at a point about which the arc of such bend is described, whereby to provide optimum exposure of said limit switch to radiant heat from the heater portions in and adjacent to such bend.

4. A heater and limit switch assembly as defined in claim 3, wherein said mounting plate has an upper flange portion bent backwardly from the plane of the plate, together with a junction box cover, whereby said plate and said cover comprise a heater junction box.

5. For use in conjunction with a rooftop air conditioner, the combination comprising A. A heater and limit switch assembly including a mounting plate, a rigid planar modified-loop electrical resistance heater comprising a first elongated end leg portion mounted at one end onto and substantially perpendicular to said mounting plate and terminating at its other end at the first end of an elongated second portion, an elongated initial return portion extending from the other end of said second portion, substantially parallel to and spaced from said first end leg portion, and, continuing therefrom, an inward offset portion extending toward said first end leg portion and substantially parallel to and spaced from said mounting plate, the length of said offset portion being substantially less than said second portion, and terminating in a second end leg portion spaced from and substantially parallel to said first end leg portion and mounted onto and substantially perpendicular to said mounting plate, in combination with a temperature responsive limit switch mounted on said plate outwardly of said end leg portion and inwardly of said initial return portion and facing said inward offset portion, together with B. a duct system for a rooftop air conditioner having a substantially vertical duct for conditioned air leading downwardly through a plenum to a ceiling-mounted air distributor box having a substantially horizontal bottom portion, a return air inlet for leading air upwardly to a rooftop air conditioner and having a vertical wall common to said plenum, a horizontal aperture through said common vertical wall through which said modified loop of the heater and limit switch assembly may be inserted into the plenum and removed therefrom, and means, on that side of the common wall accessible through the return air inlet, for securing the said heater mounting plate with the said modified heater loop positioned above and parallel to said distributor box bottom.

* * * * *